US011788523B2

(12) United States Patent
Choi et al.

(10) Patent No.: US 11,788,523 B2
(45) Date of Patent: Oct. 17, 2023

(54) LINEAR COMPRESSOR

(71) Applicant: LG ELECTRONICS INC., Seoul (KR)

(72) Inventors: Kichul Choi, Seoul (KR); Eonpyo Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 25 days.

(21) Appl. No.: 17/533,433

(22) Filed: Nov. 23, 2021

(65) Prior Publication Data

US 2022/0213879 A1 Jul. 7, 2022

(30) Foreign Application Priority Data

Jan. 4, 2021 (KR) ..... 10-2021-0000378

(51) Int. Cl.
*F04B 39/00* (2006.01)

(52) U.S. Cl.
CPC ..... *F04B 39/0061* (2013.01); *F04B 39/0072* (2013.01); *F25B 2400/02* (2013.01); *F25B 2400/073* (2013.01)

(58) Field of Classification Search
CPC ..... F04B 39/0061; F04B 39/0072; F25B 2400/073; F25B 2400/02
See application file for complete search history.

(56) References Cited

U.S. PATENT DOCUMENTS 7,306,438 B2 * 12/2007 Kang ..... F04B 39/0055 181/403
7,922,463 B2 * 4/2011 Lee ..... F04B 35/045 417/417

(Continued)

FOREIGN PATENT DOCUMENTS

CN 101589234 11/2009
CN 102007296 4/2011

(Continued)

OTHER PUBLICATIONS

Notice of Allowance in Korean Appln. No. 10-2021-0000378, dated Jul. 19, 2022, 4 pages (with English translation).

(Continued)

*Primary Examiner* — Christopher S Bobish
(74) *Attorney, Agent, or Firm* — Fish & Richardson P.C.

(57) ABSTRACT

A linear compressor includes: a shell including an intake pipe configured to suction a refrigerant, a piston configured to reciprocate in an axial direction and including a piston body, and an intake muffler coupled to the piston and configured to flow the refrigerant into the piston body and reduce a noise from the refrigerant. The intake muffler includes a first muffler disposed inside the piston body, a second muffler disposed at a rear side of the first muffler and in fluid communication with the first muffler, and a third muffler including a third muffler body having a cylindrical shape with an empty interior and configured to accommodate a portion of a rear end of the first muffler and the second muffler in the third muffler body. The third muffler body includes a streamlined portion having diameters reduced toward a rear side of the third muffler body in the axial direction.

13 Claims, 7 Drawing Sheets

(56) References Cited

U.S. PATENT DOCUMENTS

| | | | | |
|---|---|---|---|---|
| 8,366,415 | B2 * | 2/2013 | Kang | F04B 35/045 417/416 |
| 8,651,834 | B2 * | 2/2014 | Lee | F04B 39/14 417/363 |
| 9,353,773 | B2 * | 5/2016 | Lilie | F15B 15/00 |
| 9,506,461 | B2 * | 11/2016 | Inagaki | F04B 39/023 |
| 9,695,810 | B2 * | 7/2017 | Kang | F04B 35/04 |
| 9,714,648 | B2 * | 7/2017 | Kim | F04B 35/045 |
| 9,726,164 | B2 * | 8/2017 | Kang | F04B 39/14 |
| 9,989,051 | B2 * | 6/2018 | Noh | F04B 39/08 |
| 10,128,710 | B2 * | 11/2018 | Byun | H02K 1/145 |
| 10,337,748 | B2 * | 7/2019 | Watanabe | F04B 39/0055 |
| 10,495,081 | B2 * | 12/2019 | Ha | F04B 39/0044 |
| 10,871,154 | B2 * | 12/2020 | Ahn | F04B 39/121 |
| 10,890,168 | B2 * | 1/2021 | Bae | F04B 39/0055 |
| 11,530,695 | B1 * | 12/2022 | Hahn | F04B 39/0072 |
| 2005/0129534 | A1 * | 6/2005 | Lee | F04B 39/0061 417/902 |
| 2010/0260629 | A1 | 10/2010 | Kang et al. | |
| 2018/0187666 | A1 | 7/2018 | Ahn et al. | |
| 2019/0219312 | A1 * | 7/2019 | Lee | F04B 53/001 |

FOREIGN PATENT DOCUMENTS

| | | |
|---|---|---|
| CN | 102317627 | 1/2012 |
| CN | 104919179 | 9/2015 |
| CN | 206988053 | 2/2018 |
| CN | 209244773 | 8/2019 |
| KR | 20090041644 | 4/2009 |
| KR | 101480239 | 1/2015 |
| KR | 10-2015- 0040027 | 4/2015 |
| KR | 10-2019- 0031048 | 3/2019 |
| KR | 101990138 | 6/2019 |
| KR | 101990401 | 6/2019 |
| KR | 102073715 | 2/2020 |
| WO | WO 2020/166431 | 8/2020 |

OTHER PUBLICATIONS

Office Action in Chinese Appln. No. 202111404511.6, dated Apr. 23, 2023, 14 pages(with English translation).

* cited by examiner

LINEAR COMPRESSOR

CROSS-REFERENCE TO RELATED APPLICATION

This application claims priority to and the benefit of Korean Patent Application No. 10-2021-0000378 filed in the Korean Intellectual Property Office on Jan. 4, 2021.

TECHNICAL FIELD

The present disclosure relates to a compressor. More specifically, the present disclosure relates to a linear compressor for compressing a refrigerant by a linear reciprocating motion of a piston.

BACKGROUND

A compressor refers to a device that is configured to receive power from a power generator such as a motor or a turbine and compress a working fluid such as air or refrigerant, and is widely used in the whole industry and home appliances.

The compressors may be classified into a reciprocating compressor, a rotary compressor, and a scroll compressor according to a method of compressing the refrigerant.

The reciprocating compressor uses a method in which a compression chamber is formed between a piston and a cylinder to suck or discharge a working gas, and the piston linearly reciprocates in the cylinder to compress a refrigerant.

The rotary compressor uses a method in which a compression chamber is formed between a roller that eccentrically rotates and a cylinder to suck or discharge a working gas, and the roller eccentrically rotates along an inner wall of the cylinder to compress a refrigerant.

The scroll compressor uses a method in which a compression chamber is formed between an orbiting scroll and a fixed scroll to suck or discharge a working gas, and the orbiting scroll rotates along the fixed scroll to compress a refrigerant.

Recently, among the reciprocating compressors, the use of linear compressors is gradually increasing since these linear compressors can improve compression efficiency without a mechanical loss due to motion switch by directly connecting a piston to a drive motor linearly reciprocating and have a simple structure.

The linear compressor is configured such that a piston in a casing forming a sealed space sucks and compresses a refrigerant and then discharges the refrigerant while linearly reciprocating along an axial direction (or axially) in a cylinder by a linear motor.

Here, "axial direction" refers to a direction in which the piston reciprocates.

Thus, a noise occurs in a process in which the piston continues to suck, compress, and discharge the refrigerant while reciprocating in the cylinder along the axial direction.

In order to reduce the noise generated thus, a technology for installing an intake muffler in a piston body is disclosed.

With reference to FIG. 1, an intake muffler included in a related art linear compressor is described below.

FIG. 1 is a cross-sectional view illustrating configuration of an intake muffler included in a related art linear compressor.

An intake muffler 2000 included in a related art linear compressor includes a first muffler 2100 disposed in a piston body (not shown), a second muffler 2300 disposed behind the first muffler 2100, and a third muffler 2500 accommodating at least a portion of the first muffler 2100 and the second muffler 2300.

The first muffler 2100 includes a first muffler body 2110 that forms a refrigerant flow passage and extends along the axial direction, a first muffler flange 2120 extending along a radial direction (or radially) around a rear end of the first muffler body 2110, and a first flange extension 2130 extending rearward in the axial direction from a flange connection portion 2140 of the first muffler flange 2120.

The rear end of the first muffler body 2110 extends axially further rearward than the first muffler flange 2120. The rear end of the first muffler body 2110 is opened to form an inlet hole 2110*a*, and a front end of the first muffler body 2110 is opened to form a discharge hole 2110*b*.

A first extension 2210 and a second extension 2230 are positioned around the front end of the first muffler body 2110 and protrude radially at a predetermined distance to form an intake guide portion 2200. The first muffler 2100 is coupled to the third muffler 2500 by the first flange extension 2130 being press-fitted to the third muffler 2500.

A cross-sectional area of a flow passage formed inside the first flange extension 2130 may be formed to be greater than a cross-sectional area of a flow passage of the first muffler body 2110.

The second muffler 2300 includes a second muffler body 2310 that is configured such that a cross-sectional area of a flow passage of a refrigerant varies as it goes from the upstream to the downstream of the refrigerant flow based on a flow direction of the refrigerant.

The second muffler body 2310 includes a first part 2310*a* having a predetermined inner diameter and a second part 2310*b* that extends forward from the first part 2310*a* and has an inner diameter less than the inner diameter of the first part 2310*a*.

A rear end of the second muffler body 2310 of the second muffler 2300, more specifically, a rear end of the first part 2310*a* is opened, and the open rear end of the first part 2310*a* forms an inlet hole 2320*a* through which the refrigerant introduced through a through hole 2520 of the third muffler 2500 is introduced.

A front end of the second muffler body 2310, more specifically, a front end of the second part 2310*b* is opened, and the open front end of the second part 2310*b* forms a discharge hole 2320*b* discharging the refrigerant passing through the second part 2310*b*.

According to the configuration described above, the refrigerant introduced into the second muffler 2300 through the inlet hole 2320*a* of the second muffler 2300 passes through a flow passage that has a reduced cross-sectional area in a process of flowing from the first part 2310*a* to the second part 2310*b*.

The second muffler 2300 further includes a second muffler flange 2330 extending in the radial direction around the front end of the second part 2310*b* and a second flange extension 2340 extending forward from the second muffler flange 2330.

Thus, the front end of the second part 2310*b* further extends forward from the second muffler flange 2330 in the axial direction. The second flange extension 2340 may be press-fitted to an inner peripheral surface of the third muffler 2500.

A cross-sectional area of a flow passage formed inside the second flange extension 2340 may be formed to be greater than a cross-sectional area of a flow passage of the second part 2310*b*.

Thus, the refrigerant discharged from the second muffler body 2310 may diffuse while flowing in the second flange extension 2340. Since a flow rate of the refrigerant is reduced by the diffusion of the refrigerant, a noise reduction effect can be obtained.

The third muffler 2500 includes a third muffler body 2510 having a cylindrical shape with an empty interior, and the third muffler body 2510 extends axially forward and rearward.

The through hole 2520, into which an inflow guide portion (not shown) is inserted, is formed at a rear surface of the third muffler 2500, and the inflow guide portion (not shown) allows the refrigerant sucked through a refrigerant intake pipe to flow into the third muffler 2500.

The through hole 2520 may be defined as an "inlet hole" guiding the inflow of the refrigerant into the intake muffler 2000.

The third muffler 2500 further includes a protrusion 2530 extending forward from the rear surface of the third muffler 2500. The protrusion 2530 extends axially forward from an outer peripheral portion of the through hole 2520, and the inflow guide portion (not shown) may be inserted into the inside of the protrusion 2530.

The first and second mufflers 2100 and 2300 may be coupled to each other inside the third muffler 2500. For example, the first and second mufflers 2100 and 2300 may be press-fitted and coupled to the inner peripheral surface of the third muffler 2500.

In the intake muffler 2000 having the above-described configuration, the piston and the intake muffler reciprocate in the axial direction about 90 to 100 times per second depending on an operating frequency. When the compressor starts to operate, the refrigerant coming from an evaporator of a refrigerator flows into the compressor via the intake pipe. A part of the incoming refrigerant enters the into the intake muffler, and the remaining part comes into contact with the intake muffler and other components.

Accordingly, during the operation of the linear compressor, a wind loss occurs due to a pressure resistance of the refrigerant inside the casing. In this case, the pressure resistance of the refrigerant is proportional to a density of the refrigerant, a cross-sectional area of an object (which indicates a component that reciprocates in the axial direction in a state of being exposed to the refrigerant), and the square of the relative velocity of the object.

However, according to the related art intake muffler 2000, a portion positioned between the third muffler body 2510 and the protrusion 2530 is formed as a vertical portion 2550 perpendicular to the axial direction.

Accordingly, in the case of the linear compressor including the related art intake muffler 2000, according to the inventor's experiments, a forward drag coefficient was measured as 176.984, a reverse drag coefficient was measured as 190.759, and an average drag coefficient was measured as 183.872.

The drag coefficients were measured on the condition that the number of Reynolds was set to 10,000. Thus, there is a need to develop the intake muffler capable of reducing the wind loss occurring when the piston and the intake muffler reciprocate in the axial direction.

SUMMARY

An object of the present disclosure is to provide a linear compressor capable of reducing a wind loss occurring during an operation of the linear compressor.

Another object of the present disclosure is to provide a linear compressor including an intake muffler capable of reducing a wind loss occurring during an operation of the linear compressor.

Another object of the present disclosure is to provide a linear compressor including an intake muffler capable of improving compression efficiency.

To achieve the above-described and other objects, a linear compressor according to one aspect of the present disclosure comprises an intake muffler.

The intake muffler includes a first muffler disposed inside a piston body, a second muffler that is disposed at a rear of the first muffler in an axial direction and communicates with the first muffler, and a third muffler that includes a third muffler body having a cylindrical shape with an empty interior and accommodates a portion of a rear end of the first muffler and the second muffler in the third muffler body. The third muffler body includes a streamlined portion having a decreasing diameter as it goes to a rear in the axial direction.

Since the linear compressor according to an embodiment of the present disclosure includes the third muffler body including the streamlined portion having the decreasing diameter as it goes to the rear in the axial direction, a wind loss occurring due to a pressure resistance of a refrigerant inside a casing while a piston and the intake muffler reciprocate in the axial direction about 90 to 100 times per second can be reduced compared to the related art linear compressor.

According to the inventor's experiments, in the linear compressor including the third muffler according to an embodiment of the present disclosure, a forward drag coefficient was measured as 104.422, a reverse drag coefficient was measured as 86.06, and an average drag coefficient was measured as 95.241.

Accordingly, since the average drag coefficient in the present disclosure can be reduced by about 48% compared to the related art linear compressor, a wind loss occurring during the operation of the compressor can be reduced efficiently.

BRIEF DESCRIPTION OF THE DRAWINGS

The accompanying drawings, which are included to provide a further understanding of the present disclosure and constitute a part of the detailed description, illustrate embodiments of the present disclosure and serve to explain technical features of the present disclosure together with the description.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts.

It should be understood that when a component is described as being "connected to" or "coupled to" other component, it may be directly connected or coupled to the other component or intervening component(s) may be present.

It will be noted that a detailed description of known arts will be omitted if it is determined that the detailed description of the known arts can obscure embodiments of the present disclosure. The accompanying drawings are used to help easily understand various technical features and it should be understood that embodiments presented herein are not limited by the accompanying drawings. As such, the present disclosure should be understood to extend to any alterations, equivalents and substitutes in addition to those which are particularly set out in the accompanying drawings.

In addition, a term of "disclosure" may be replaced by document, specification, description, etc.

Figure 1:
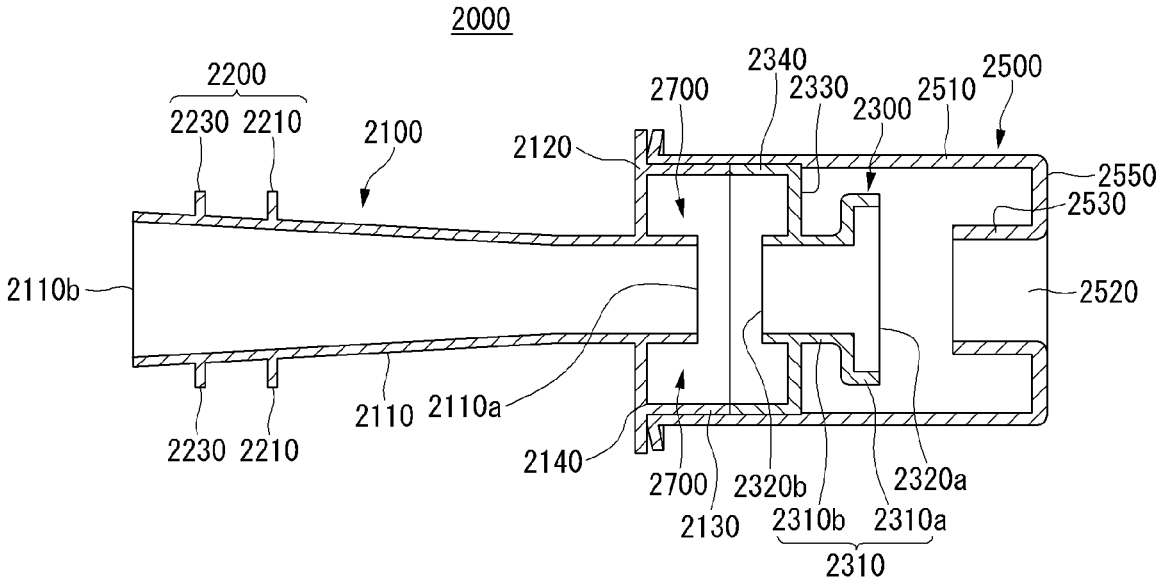
FIG. 1 is a cross-sectional view illustrating configuration of an intake muffler according to a related art.
Figure 2:
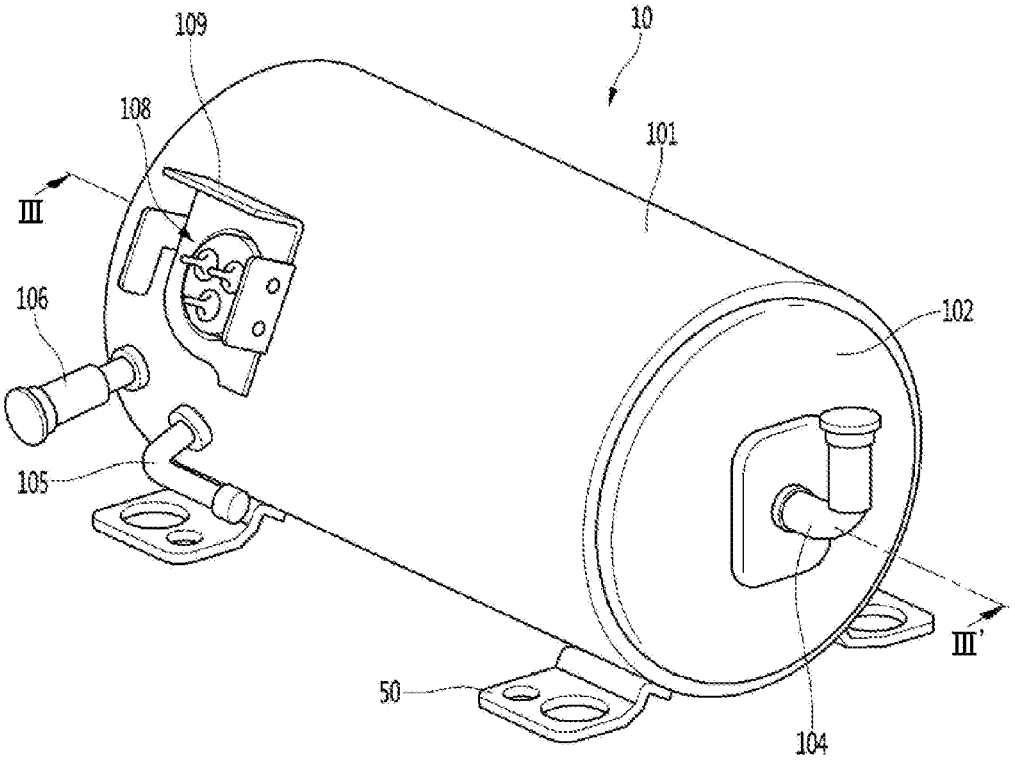
FIG. 2 is an appearance perspective view illustrating configuration of a linear compressor according to an embodiment of the present disclosure.
Figure 3:
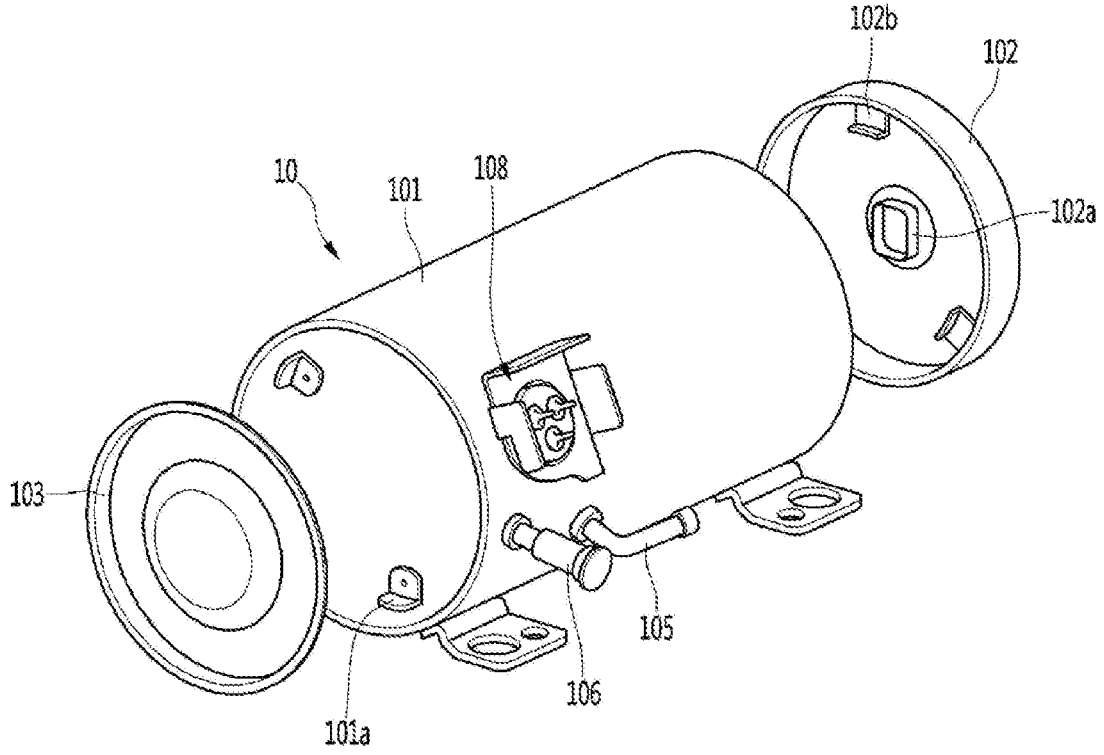
FIG. 3 is an exploded perspective view of a shell and a shell cover of a linear compressor according to an embodiment of the present disclosure.
Figure 4:
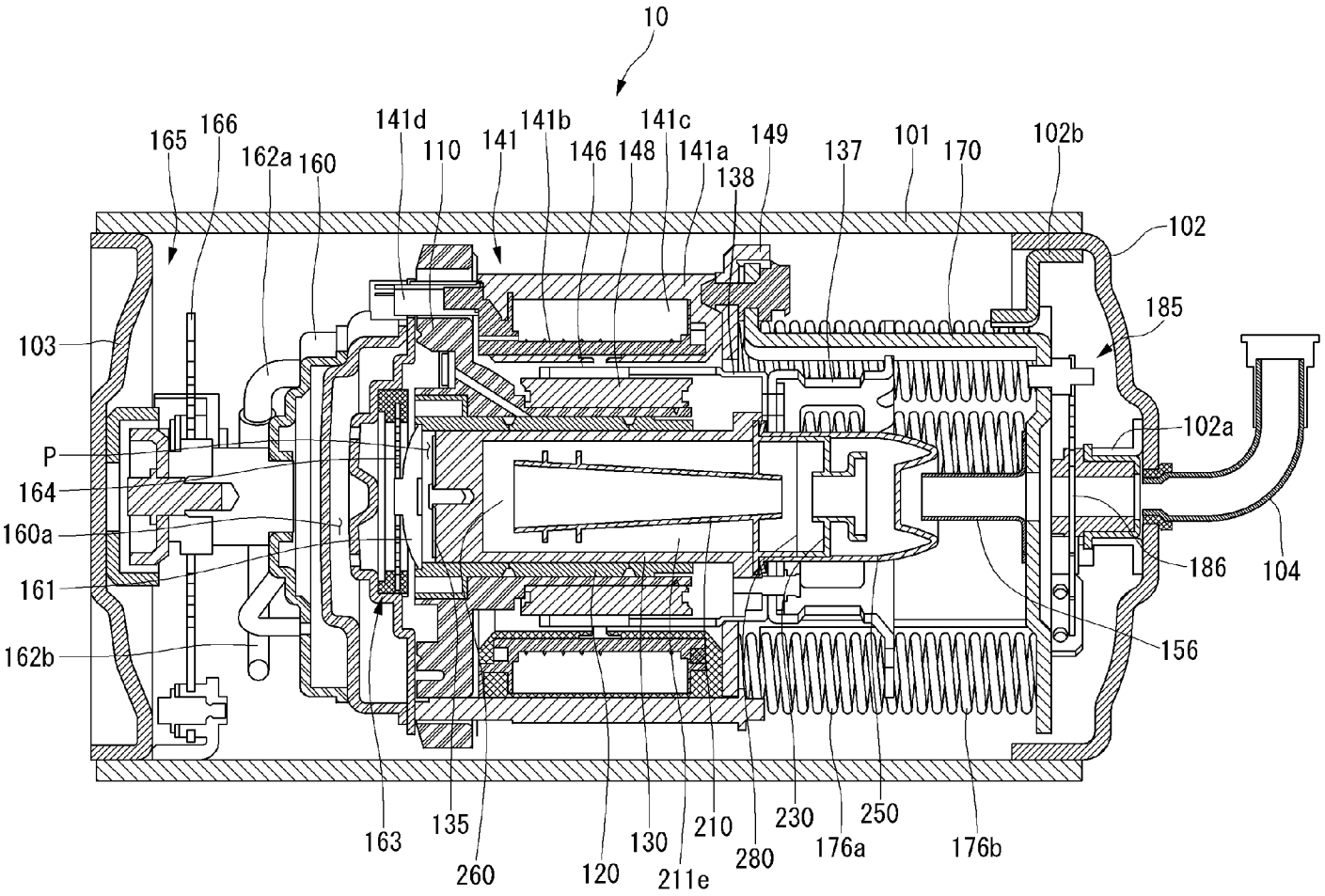
FIG. 4 is a cross-sectional view taken along line of FIG. 2.

FIG. 2 is an appearance perspective view illustrating configuration of a linear compressor according to an embodiment of the present disclosure. FIG. 3 is an exploded perspective view of a shell and a shell cover of a linear compressor according to an embodiment of the present disclosure. FIG. 4 is a cross-sectional view taken along line III-III' of FIG. 2.

Referring to the figures, a linear compressor 10 according to an embodiment of the present disclosure includes a shell 101 and shell covers 102 and 103 coupled to the shell 101. In a broad sense, the first shell cover 102 and the second shell cover 103 can be understood as one configuration of the shell 101.

Legs 50 may be coupled to a lower side of the shell 101. The legs 50 may be coupled to a base of a product in which the linear compressor 10 is installed. Examples of the product may include a refrigerator, and the base may include a machine room base of the refrigerator. As another example, the product may include an outdoor unit of an air conditioner, and the base may include a base of the outdoor unit.

The shell 101 may have a substantially cylindrical shape and may be disposed in a transverse direction or a horizontal direction or an axial direction. FIG. 3 illustrates that the shell 101 is extended in the horizontal direction and has a slightly low height in a radial direction, by way of example.

That is, since the linear compressor 10 can have a low height, there is an advantage in that a height of the machine room can decrease when the linear compressor 10 is installed in the machine room base of the refrigerator.

A terminal 108 may be installed on an outer surface of the shell 101. The terminal 108 is understood as configuration to transmit external electric power to a motor assembly of the linear compressor 10. The terminal 108 may be connected to a lead line of a coil 141*c* (see FIG. 4).

A bracket 109 is installed on the outside of the terminal 108. The bracket 109 may include a plurality of brackets surrounding the terminal 108. The bracket 109 can perform a function of protecting the terminal 108 from an external impact, etc.

Both sides of the shell 101 are configured to be opened. The shell covers 102 and 103 may be coupled to both sides of the opened shell 101.

The shell covers 102 and 103 include the first shell cover 102 coupled to one opened side of the shell 101 and the second shell cover 103 coupled to the other opened side of the shell 101. An inner space of the shell 101 may be sealed by the shell covers 102 and 103.

FIG. 2 illustrates that the first shell cover 102 is positioned on the right side of the linear compressor 10, and the second shell cover 103 is positioned on the left side of the linear compressor 10, by way of example. Thus, the first and second shell covers 102 and 103 may be disposed to face each other.

The linear compressor 10 further includes a plurality of pipes 104, 105, and 106 that are included in the shell 101 or the shell covers 102 and 103 and may suck, discharge, or inject the refrigerant.

The plurality of pipes 104, 105, and 106 include an intake pipe 104 that allows the refrigerant to be sucked into the linear compressor 10, a discharge pipe 105 that allows the compressed refrigerant to be discharged from the linear compressor 10, and a process pipe 106 for supplementing the refrigerant in the linear compressor 10.

For example, the intake pipe 104 may be coupled to the first shell cover 102. The refrigerant may be sucked into the linear compressor 10 along the axial direction through the intake pipe 104.

The discharge pipe 105 may be coupled to an outer peripheral surface of the shell 101. The refrigerant sucked through the intake pipe 104 may be compressed while flowing in the axial direction. The compressed refrigerant may be discharged through the discharge pipe 105. The discharge pipe 105 may be disposed closer to the second shell cover 103 than to the first shell cover 102.

The process pipe 106 may be coupled to the outer peripheral surface of the shell 101. A worker may inject the refrigerant into the linear compressor 10 through the process pipe 106.

The process pipe 106 may be coupled to the shell 101 at a different height from the discharge pipe 105 in order to prevent interference with the discharge pipe 105. Herein, the "height" may be understood as a distance measured from the leg 50 in a vertical direction (or a radial direction).

On an inner peripheral surface of the shell 101 corresponding to a location at which the process pipe 106 is coupled, at least a portion of the second shell cover 103 may be positioned adjacently. In other words, at least a portion of the second shell cover 103 may act as a resistance of the refrigerant injected through the process pipe 106.

Thus, with respect to a flow passage of the refrigerant, a size of the flow passage of the refrigerant introduced through the process pipe 106 may be configured to decrease while the refrigerant enters into the inner space of the shell 101.

In this process, a pressure of the refrigerant may be reduced to vaporize the refrigerant, and an oil contained in the refrigerant may be separated. Thus, while the refrigerant, from which the oil is separated, is introduced into a piston 130, a compression performance of the refrigerant can be improved. The oil may be understood as a working oil present in a cooling system.

A cover support portion 102*a* is provided at the inner surface of the first shell cover 102. A second support device 185 to be described later may be coupled to the cover support portion 102*a*. The cover support portion 102*a* and the second support device 185 may be understood as devices for supporting the main body of the linear compressor 10.

Here, the main body of the compressor refers to a component provided inside the shell 101, and may include, for example, a driver that reciprocates forward and rearward and a support portion supporting the driver.

The driver may include a piston 130, a magnet frame 138, a permanent magnet 146, a supporter 137, an intake muffler 200, and the like. The support portion may include resonance springs 176*a* and 176*b*, a rear cover 170, a stator cover 149, a first support device 165, and a second support device 185, and the like.

A stopper 102*b* may be provided at the inner surface of the first shell cover 102. The stopper 102*b* is understood as configuration to prevent the main body of the compressor 10, in particular, a motor assembly (not shown) from being damaged by colliding with the shell 101 due to a vibration or an impact, etc. generated during transportation of the linear compressor 10.

The stopper 102*b* is positioned adjacent to the rear cover 170 to be described later. The stopper 102*b* can prevent an impact from being transferred to the motor assembly (not shown) since the rear cover 170 interferes with the stopper 102*b* when shaking occurs in the linear compressor 10.

A spring fastening portion 101*a* may be provided on the inner peripheral surface of the shell 101. The spring fastening portion 101*a* may be disposed adjacent to the second shell cover 103. The spring fastening portion 101*a* may be coupled to a first support spring 166 of a first support device 165 to be described later. As the spring fastening portion 101*a* and the first support device 165 are coupled, the main body of the compressor may be stably supported inside the shell 101.

Figure 5:
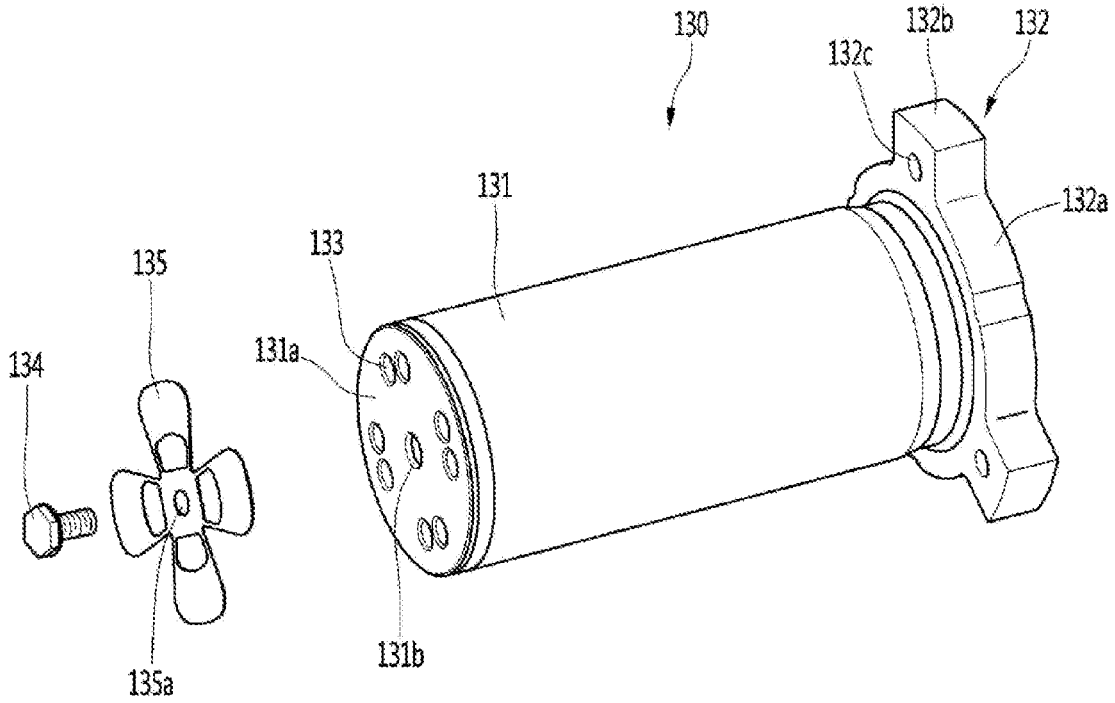
FIG. 5 is an exploded perspective view illustrating configuration of a piston assembly according to an embodiment of the present disclosure.

FIG. 4 is a cross-sectional view taken along line of FIG. 2. FIG. 5 is an exploded perspective view illustrating configuration of a piston assembly according to an embodiment of the present disclosure.

Referring to FIGS. 4 and 5, the linear compressor 10 according to an embodiment of the present disclosure includes a cylinder 120 provided in the shell 101, a piston 130 that linearly reciprocates in the cylinder 120, and a motor assembly (not shown) including a linear motor that gives a driving force to the piston 130.

When the motor assembly (not shown) drives, the piston 130 may reciprocate in the axial direction.

The linear compressor 10 further includes an intake muffler 200 coupled to the piston 130. The intake muffler 200 can reduce a noise generated from a refrigerant sucked through an intake pipe 104.

The refrigerant sucked through the intake pipe 104 passes through the intake muffler 200 and flows into the piston 130. For example, in a process in which the refrigerant passes through the intake muffler 200, the flow noise of the refrigerant can be reduced.

The intake muffler 200 includes a plurality of mufflers 210, 230, and 250. The plurality of mufflers 210, 230, and 250 include a first muffler 210, a second muffler 230, and a third muffler 250 that are coupled to each other.

The first muffler 210 is positioned in the piston 130, and the second muffler 230 is coupled to the rear of the first muffler 210. The third muffler 250 may accommodate the second muffler 230 therein and may extend to the rear of the first muffler 210.

From a perspective of the flow direction of the refrigerant, the refrigerant sucked through the intake pipe 104 may sequentially pass through the third muffler 250, the second muffler 230, and the first muffler 210. In this process, the flow noise of the refrigerant can be reduced.

The intake muffler 200 further includes a muffler filter 280. The muffler filter 280 may be positioned at an interface where the first muffler 210 and the second muffler 230 are coupled. For example, the muffler filter 280 may have a circular shape, and an outer peripheral portion of the muffler filter 280 may be supported between the first and second mufflers 210 and 230.

In the present disclosure, "axial direction (or axially)" may be understood as a direction in which the piston 130 reciprocates, i.e., a longitudinal direction in FIG. 4. In the "axial direction", a direction directed from the intake pipe 104 to a compression chamber P, i.e., a direction in which the refrigerant flows may be understood as "front", and the opposite direction thereof may be understood as "rear".

On the other hand, "radial direction (or radially)" may be understood as a direction perpendicular to the direction in which the piston 130 reciprocates, i.e., a transverse direction in FIG. 4.

The piston 130 includes a piston body 131 having a substantially cylindrical shape and a piston flange 132 extending radially from the piston body 131.

The piston body 131 may reciprocate axially inside the cylinder 120, and the piston flange 132 may reciprocate axially outside the cylinder 120.

The cylinder 120 is configured to accommodate at least a portion of the first muffler 210 and at least a portion of the piston body 131.

The compression chamber P in which the refrigerant is compressed by the piston 130 is formed in the cylinder 120. An intake port 133 that introduces the refrigerant into the compression chamber P is formed at a front surface of the piston body 131, and an intake valve 135 that selectively opens the intake port 133 is provided at the front of the intake port 133. A second fastening hole 135*a* to which a valve fastening member 134 is coupled is formed at approximately the center of the intake valve 135.

The valve fastening member 134 may be understood as configuration to couple the intake valve 135 to a first fastening hole 131*b* of the piston 130. The first fastening hole 131*b* is formed at approximately the center of a front end surface of the piston 130. The valve fastening member 134 may pass through the second fastening hole 135*a* of the intake valve 135 and may be coupled to the first fastening hole 131*b*.

The piston 130 includes the piston body 131 that has a substantially cylindrical shape and extends forward and rearward, and the piston flange 132 extending radially outwardly from the piston body 131.

A body front portion 131*a* in which the first fastening hole 131*b* is formed is provided at the front of the piston body 131. The intake port 133 selectively shielded by the intake valve 135 is formed at the body front portion 131*a*. The intake port 133 includes a plurality of intake ports, and the plurality of intake ports 133 are formed outside the first fastening hole 131*b*.

The plurality of intake ports 133 may be disposed to surround the first fastening hole 131*b*. For example, the eight intake ports 133 may be provided.

A rear portion of the piston body 131 is opened so that the intake of the refrigerant is achieved. At least a portion of the intake muffler 200, i.e., the first muffler 210 may be inserted into the piston body 131 through the opened rear portion of the piston body 131.

The piston flange 132 includes a flange body 132*a* extending radially outwardly from the rear portion of the piston body 131, and a piston fastening portion 132*b* further extending radially outwardly from the flange body 132*a*.

The piston fastening portion 132*b* includes a piston fastening hole 132*c* to which a predetermined fastening member is coupled. The fastening member may pass through the piston fastening hole 132*c* and may be coupled to a magnet frame 138 and a supporter 137. The piston fastening portion 132*b* may include a plurality of piston fastening portions 132*b*, and the plurality of piston fastening portions 132*b* may be spaced apart from each other and disposed at an outer peripheral surface of the flange body 132*a*.

At the front of the compression chamber P, a discharge cover 160 forming a discharge space 160*a* of the refrigerant discharged from the compression chamber P, and discharge valve assemblies 161 and 163 that are coupled to the discharge cover 160 and selectively discharge the refrigerant compressed in the compression chamber P are provided. The discharge space 160*a* includes a plurality of spaces partitioned by an inner wall of the discharge cover 160. The plurality of spaces may be disposed forward and rearward and may communicate with each other.

The discharge valve assemblies 161 and 163 include a discharge valve 161 that is opened when a pressure of the compression chamber P is greater than or equal to a discharge pressure, and introduces the refrigerant into the discharge space 160*a* of the discharge cover 160, and a spring assembly 163 that is provided between the discharge valve 161 and the discharge cover 160 and provides axially an elastic force.

The spring assembly 163 may include a valve spring (not shown) and a spring support portion (not shown) for supporting the valve spring (not shown) to the discharge cover 160.

For example, the valve spring (not shown) may be formed as a leaf spring. The spring support portion (not shown) may be integrally injection-molded with the valve spring (not shown) by an injection process.

The discharge valve 161 is coupled to the valve spring (not shown), and a rear portion or a rear surface of the discharge valve 161 is positioned so that it is supportable to the front surface of the cylinder 120.

When the discharge valve 161 is supported to the front surface of the cylinder 120, the compression chamber P may maintain a sealed state. When the discharge valve 161 is spaced apart from the front surface of the cylinder 120, the compression chamber P may be opened, and the compressed refrigerant inside the compression chamber P may be discharged.

The compression chamber P may be defined as a space between the intake valve 135 and the discharge valve 161.

The intake valve 135 may be formed on one side of the compression chamber P, and the discharge valve 161 may be provided on other side of the compression chamber P, that is, on the opposite side of the intake valve 135.

In the process in which the piston 130 reciprocates linearly in the axial direction inside the cylinder 120, when the pressure of the compression chamber P is lower than the discharge pressure and is less than or equal to an intake pressure, the discharge valve 161 is closed and the intake valve 135 is opened. Hence, the refrigerant is sucked into the compression chamber P.

On the other hand, when the pressure of the compression chamber P is greater than or equal to the intake pressure, the refrigerant in the compression chamber P is compressed in the closed state of the intake valve 135.

When the pressure of the compression chamber P is greater than or equal to the intake pressure, the valve spring (not shown) is deformed forward to open the discharge valve 161, and the refrigerant is discharged from the compression chamber P and is discharged into the discharge space 160*a* of the discharge cover 160.

When the discharge of the refrigerant is completed, the valve spring (not shown) provides a restoring force to the discharge valve 161, and thus the discharge valve 161 is closed.

The linear compressor 10 further includes a cover pipe 162*a* that is coupled to the discharge cover 160 and discharges the refrigerant flowing in the discharge space 160*a* of the discharge cover 160. For example, the cover pipe 162*a* may be made of a metal material.

The linear compressor 10 further includes a loop pipe 162*b* that is coupled to the cover pipe 162*a* and transfers the refrigerant flowing through the cover pipe 162*a* to the discharge pipe 105. One side of the loop pipe 162*b* may be coupled to the cover pipe 162*a*, and other side may be coupled to the discharge pipe 105.

The loop pipe 162*b* may be made of a flexible material. The loop pipe 162*b* may roundly extend from the cover pipe 162*a* along the inner peripheral surface of the shell 101 and may be coupled to the discharge pipe 105. For example, the loop pipe 162*b* may have a wound shape.

The linear compressor 10 further includes a frame 110 fixing the cylinder 120. For example, the cylinder 120 may be press-fitted to the inside of the frame 110. The cylinder 120 and the frame 110 may be made of aluminum or an aluminum alloy material.

The frame 110 is disposed to surround the cylinder 120. That is, the cylinder 120 may be positioned to be accommodated inside the frame 110. The discharge cover 160 may be coupled to a front surface of the frame 110 by a fastening member.

The motor assembly (not shown) includes an outer stator 141 that is fixed to the frame 110 and is disposed to surround the cylinder 120, an inner stator 148 that is disposed to be spaced apart from the inside of the outer stator 141, and a permanent magnet 146 positioned in a space between the outer stator 141 and the inner stator 148.

The permanent magnet 146 may reciprocate linearly by a mutual electromagnetic force between the permanent magnet 146 and the outer stator 141 and the inner stator 148. The permanent magnet 146 may be composed of a single magnet having one pole, or may be configured by combining a plurality of magnets having three poles.

The permanent magnet 146 may be installed in the magnet frame 138. The magnet frame 138 has a substantially cylindrical shape and may be inserted into a space between the outer stator 141 and the inner stator 148.

Based on the cross-sectional view of FIG. 4, the magnet frame 138 may be coupled to the piston flange 132, extended outward in the radial direction, and bent forward. The permanent magnet 146 may be installed in a front portion of the magnet frame 138.

When the permanent magnet 146 reciprocates, the piston 130 may reciprocate axially along with the permanent magnet 146.

The outer stator 141 includes coil winding bodies 141*b*, 141*c*, and 141*d* and a stator core 141*a*. The coil winding bodies 141*b*, 141*c*, and 141*d* include a bobbin 141*b* and a coil 141*c* wound in a circumferential direction of the bobbin 141*b*.

The coil winding bodies 141*b*, 141*c*, and 141*d* further include a terminal portion 141*d* for guiding a power supply line connected to the coil 141*c* to be withdrawn or exposed to the outside of the outer stator 141. The terminal portion 141*d* may be disposed to be inserted into a terminal insertion portion of the frame 110.

The stator core 141*a* includes a plurality of core blocks that is configured such that a plurality of laminations is stacked in a circumferential direction. The plurality of core blocks may be disposed to surround at least a portion of the coil winding bodies 141*b* and 141*c*.

The stator cover 149 is provided on one side of the outer stator 141. That is, one side of the outer stator 141 may be supported by the frame 110, and other side may be supported by the stator cover 149.

The linear compressor 10 further includes a cover fastening member (not shown) for fastening the stator cover 149 and the frame 110. The cover fastening member (not shown) may pass through the stator cover 149, extend forward toward the frame 110, and may be coupled to a first fastening hole of the frame 110.

The inner stator 148 is fixed to the outer periphery of the frame 110. Further, the inner stator 148 is configured such that a plurality of laminations is stacked in a circumferential direction from the outside of the frame 110.

The linear compressor 10 further includes a supporter 137 supporting the piston 130. The supporter 137 is coupled to the rear side of the piston 130, and the intake muffler 200 may be disposed inside the supporter 137 to pass therethrough.

The piston flange 132, the magnet frame 138, and the supporter 137 may be fastened by a fastening member.

A balance weight (not shown) may be coupled to the supporter 137. A weight of the balance weight (not shown) may be determined based on an operating frequency range of the compressor body.

The linear compressor 10 further includes a rear cover 170 that is coupled to the stator cover 149, extends rearward, and is supported by the second support device 185.

The rear cover 170 includes three support legs, and the three support legs may be coupled to the rear surface of the stator cover 149. A spacer (not shown) may be interposed between the three support legs and the rear surface of the stator cover 149.

A distance from the stator cover 149 to a rear end of the rear cover 170 may be determined by adjusting a thickness of the spacer (not shown). The rear cover 170 may be elastically supported by the supporter 137.

The linear compressor 10 further includes an inflow guide portion 156 that is coupled to the rear cover 170 and guides the inflow of the refrigerant into the intake muffler 200. At least a portion of the inflow guide portion 156 may be inserted into the inside of the intake muffler 200.

The linear compressor 10 further includes a plurality of resonance springs 176*a* and 176*b* in which each natural frequency is adjusted so that the piston 130 can perform a resonant motion.

The plurality of resonance springs 176*a* and 176*b* include a first resonance spring 176*a* supported between the supporter 137 and the stator cover 149 and a second resonance spring 176*b* supported between the supporter 137 and the rear cover 170.

By the action of the plurality of resonance springs 176*a* and 176*b*, a stable movement of the driver reciprocating in the linear compressor 10 can be performed, and generation of vibration or noise caused by the movement of the driver can be reduced.

The supporter 137 includes a first spring support portion (not shown) coupled to the first resonance spring 176*a*.

The linear compressor 10 further includes a first support device 165 that is coupled to the discharge cover 160 and supports one side of the main body of the compressor 10. The first support device 165 may be disposed adjacent to the second shell cover 103 to elastically support the main body of the compressor 10.

The first support device 165 includes a first support spring 166. The first support spring 166 may be coupled to the spring fastening portion 101*a*.

The linear compressor 10 further includes a second support device 185 that is coupled to the rear cover 170 and supports other side of the main body of the compressor 10. The second support device 185 may be coupled to the first shell cover 102 to elastically support the main body of the compressor 10.

The second support device 185 includes a second support spring 186.

The second support spring 186 may be coupled to the cover support portion 102*a*.

Figure 6:
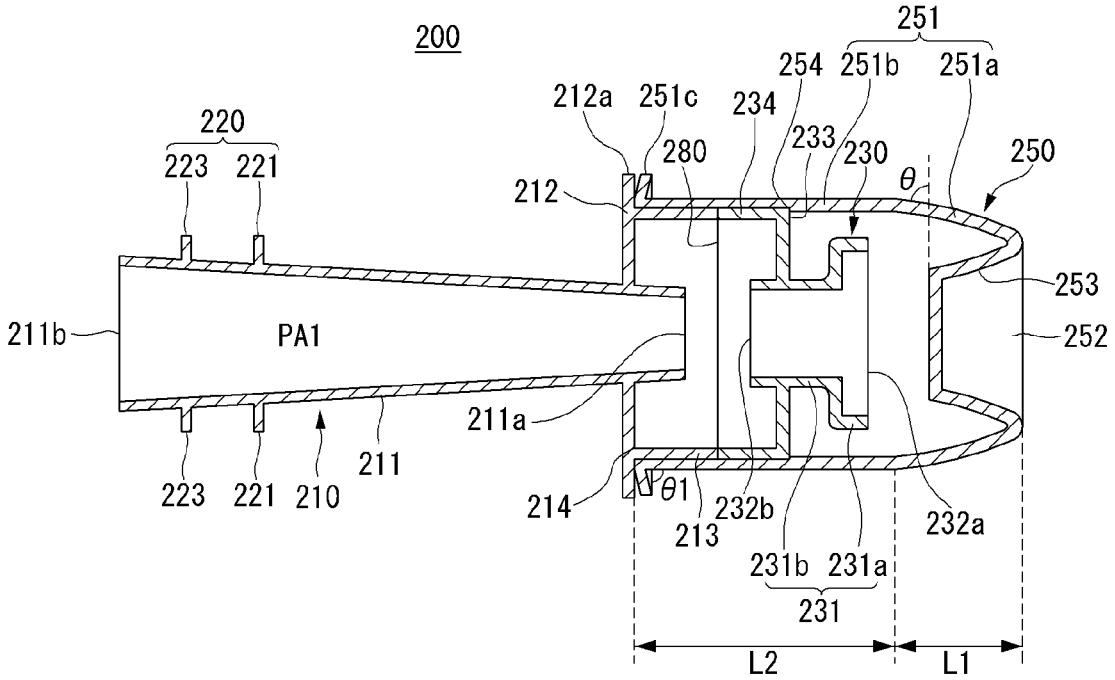
FIG. 6 is a cross-sectional view of an intake muffler according to a first embodiment of the present disclosure.

FIG. 6 is a cross-sectional view of an intake muffler according to a first embodiment of the present disclosure.

Referring to FIG. 6, an intake muffler 200 according to an embodiment of the present disclosure includes a plurality of mufflers 210, 230, and 250. The plurality of mufflers 210, 230, and 250 may be press-fitted and coupled to each other.

The plurality of mufflers 210, 230, and 250 may be made of a plastic material and easily press-fitted and coupled to each other. Hence, and a heat loss through the plurality of mufflers 210, 230, and 250 in the flow process of the refrigerant can be reduced.

The intake muffler 200 includes a first muffler 210, a second muffler 230 coupled to the rear of the first muffler 210, a muffler filter 280 supported by the first muffler 210 and the second muffler 230, and a third muffler 250 that is coupled to the first and second mufflers 210 and 230 and into which the inflow guide portion 156 is inserted. The third muffler 250 extends to the rear of the second muffler 230.

The third muffler 250 includes a third muffler body 251 having a cylindrical shape with an empty interior. The third muffler body 251 extends forward and rearward.

The third muffler body 251 includes a streamlined portion 251*a* having a decreasing diameter as it goes to a rear in the axial direction, and a muffler accommodating portion 251*b* that extends to an axial direction front of the streamlined portion 251*a* and accommodates a portion of a rear end of the first muffler 210 and the second muffler 230.

In the present embodiment, an axial length L1 of the streamlined portion 251*a* is less than an axial length L2 of the muffler accommodating portion 251*b*. The axial length L1 of the streamlined portion 251*a* is formed as 15.3 mm.

The streamlined portion 251*a* of the third muffler body 251 has an inclination angle θ of about 80° with respect to the radial direction perpendicular to the axial direction.

The third muffler 250 further includes a protrusion 253 that is provided at a rear end of the third muffler 250, more specifically, at a rear end of the streamlined portion 251*a* of the third muffler body 251 and extends forward in the axial direction from the rear end of the streamlined portion 251*a*.

The protrusion 253 may be formed to be inclined in the opposite direction to the inclination angle θ of the streamlined portion 251*a*.

A through hole 252, into which the inflow guide portion 156 is inserted, is formed at the protrusion 253. The through hole 252 may be defined as an "inlet hole" guiding the inflow of the refrigerant into the intake muffler 200.

The first and second mufflers 210 and 230 may be coupled to each other inside the third muffler 250. For example, the first and second mufflers 210 and 230 may be press-fitted and coupled to an inner peripheral surface of the third muffler 250. A stepped portion 254, to which the second muffler 230 is coupled, is formed at the inner peripheral surface of the third muffler 250.

When the second muffler 230 moves into the third muffler 250 and is press-fitted to the third muffler 250, the second muffler 230 may be caught in the stepped portion 254. Thus, the stepped portion 254 may be understood as a stopper for limiting the rearward movement of the second muffler 230.

The first muffler 210 is coupled to a front end of the second muffler 230 and is press-fitted to the inner peripheral surface of the third muffler 250. The muffler filter 280 may be interposed at a boundary where the first and second mufflers 210 and 230 are coupled.

The second muffler 230 includes a second muffler body 231 that is configured such that a cross-sectional area of a flow passage of the refrigerant changes as it goes from the upstream to the downstream of the refrigerant flow based on a flow direction of the refrigerant. An inlet hole 232*a*, through which the refrigerant discharged from the inflow guide portion 156 is introduced, is formed at a rear end of the second muffler body 231.

The second muffler body 231 includes a first part 231*a* that extends from the inlet hole 232*a* toward the front to have a predetermined inner diameter, and a second part 231*b* that extends from the first part 231*a* to the front and has an inner diameter less than the inner diameter of the first part 231*a*. The inlet hole 232*a* of the second muffler 230 is formed at a rear end of the first part 231*a*.

According to the configuration described above, the refrigerant introduced into the second muffler 230 through the inlet hole 232*a* of the second muffler 230 passes through a flow passage that has a reduced cross-sectional area in a process of flowing from the first part 231*a* to the second part 231*b*.

A discharge hole 232*b* discharging the refrigerant passing through the second part 231*b* is formed at a front end of the second muffler body 231. The discharge hole 232*b* of the second muffler 230 may be formed at a front end of the second part 231*b*.

The second muffler 230 includes a second muffler flange 233, that extends radially from an outer peripheral surface of a front portion of the second muffler body 231, more specifically, an outer peripheral surface of the second part 231*b*, and a second flange extension 234 extending forward from the second muffler flange 233. The second muffler flange 233 may be radially formed at the outer peripheral surface of the second part 231*b*, and the second flange extension 234 may be press-fitted to the inner peripheral surface of the third muffler 250.

A boundary between the second muffler flange 233 and the second flange extension 234 of the second muffler 230, that is, a portion bent from the radial direction to the axial direction may form a "locking jaw" that allows the second muffler 230 to be caught in the stepped portion 254 of the third muffler 250.

A cross-sectional area of a flow passage formed inside the second flange extension 234 may be formed to be greater than a cross-sectional area of a flow passage of the second part 231*b*.

The first muffler 210 includes a first muffler body 211 positioned in front of the muffler filter 280, that is, positioned on the downstream side of the refrigerant flow. The first muffler body 211 of the first muffler 210 has a cylindrical shape with an empty interior and may extend forward. An inner space of the first muffler body 211 forms a main flow passage PA1 through which the refrigerant flows.

The first muffler 210 includes a first muffler flange 212 radially formed on an outer peripheral surface of the first muffler body 211, and a first flange extension 213 extending axially rearward from the first muffler flange 212.

The first flange extension 213 may have a substantially cylindrical shape. The first flange extension 213 may be press-fitted in the inner peripheral surface of the third muffler 250. The first muffler flange 212 includes a flange connection portion 214 to which the first flange extension 213 is connected.

The first flange extension 213 may support a front portion of the muffler filter 280. In other words, the muffler filter 280 may be interposed between the first flange extension 213 of the first muffler 210 and the second flange extension 234 of the second muffler 230.

The first muffler body 211 may be configured such that a longitudinal cross-sectional area of the main flow passage PA1 increases as it goes from the upstream to the downstream based on the flow direction of the refrigerant.

An intake guide portion 220 may be formed around a discharge hole 211*b* of the first muffler 210 at the first muffler body 211 and may guide the refrigerant discharged from the discharge hole 211*b* to the intake port 133.

The intake guide portion 220 is configured to surround at least a portion of the first muffler body 211. The intake guide portion 220 may include a first extension 221 extending outward in the radial direction from a position on the outer peripheral surface of the first muffler body 211 and a second extension 223 that is forward spaced apart from the first extension 221.

The inlet hole 211*a* into which the refrigerant passing through the muffler filter 280 is introduced is formed at the rear end of the first muffler body 211. The discharge hole 211*b* through which the refrigerant passing through the first muffler body 211 is discharged is formed at the front end of the first muffler body 211.

The first muffler flange 212 may be coupled to the piston flange 132 of the piston 130.

A radially outer portion of the first muffler flange 212 includes a piston coupling portion 212*a* coupled to a coupling groove (not shown) of the piston 130. The fastening groove (not shown) may be formed in a piston flange portion (not shown).

The third muffler 250 includes a piston coupling portion 251*c* coupled to the piston coupling portion 212*a*.

The piston coupling portion 251*c* of the third muffler 250 may be configured to extend outward in the radial direction from the front portion of the third muffler body 251.

The piston coupling portions 212*a* and 251*c* may be interposed between the supporter 137 and the piston flange portion (not shown). The piston coupling portion 251*c* may extend to be inclined outward in the radial direction with respect to the third muffler body 251. An angle θ between the third muffler body 251 and the piston coupling portion 251*c* may be greater than 60° and less than 90°. The piston coupling portion 251*c* may be configured to be elastically deformable.

According to the above-described configuration, the piston coupling portions 212*a* and 251*c* can be stably supported between the supporter 137 and the piston flange portion (not shown). In the process of moving forward or rearward the intake muffler 200, the piston coupling portions 212*a* and 251*c* can move to be close to each other or spaced apart from each other by an inertial force, and hence, an excessive load can be prevented from being applied to the intake muffler 200.

The main flow passage PA1 of the first muffler body 211 may be configured such that a cross-sectional area of the flow passage of the refrigerant increases as it goes from the upstream to the downstream based on the flow direction of the refrigerant.

An operation of the linear compressor according to an embodiment of the present disclosure is described below.

The refrigerant sucked into the compressor 10 flows into the intake muffler 200 through the through hole 252 of the third muffler 250.

The refrigerant may pass through the second muffler 230 and may be introduced into the first muffler body 211 of the first muffler 210 through the inlet hole 211*a* of the first muffler 210.

The refrigerant in the first muffler body 211 may flow into the intake space 260, and may be sucked into the compression chamber P through the intake port 133 of the piston 130 when the intake valve 135 is opened. Here, the intake space 260 may be understood as a space between the body front portion 131*a* of the piston 130 and the front end of the intake muffler 200, i.e., the front end of the first muffler 210.

When a pressure of the compression chamber P is higher than a pressure of the intake space 260, the intake valve 135 is closed, and a volume of the compression chamber P decreases while the piston 130 moves forward. Hence, the compression of the refrigerant is achieved.

When the pressure of the compression chamber P increases and is higher than a pressure of the discharge space 160*a*, the discharge of the refrigerant is achieved while the discharge valve 161 is opened.

When the discharge of the refrigerant is achieved, the piston 130 and the intake muffler 200 move to the rear, and the refrigerant is sucked into the intake muffler 200.

When the pressure of the compression chamber P and an internal pressure of the piston 130 are the same, the intake valve 135 is closed, and the internal pressure of the piston 130 gradually increases while the refrigerant flowing into the piston 130 fills the inside of the piston 130.

Figure 7:
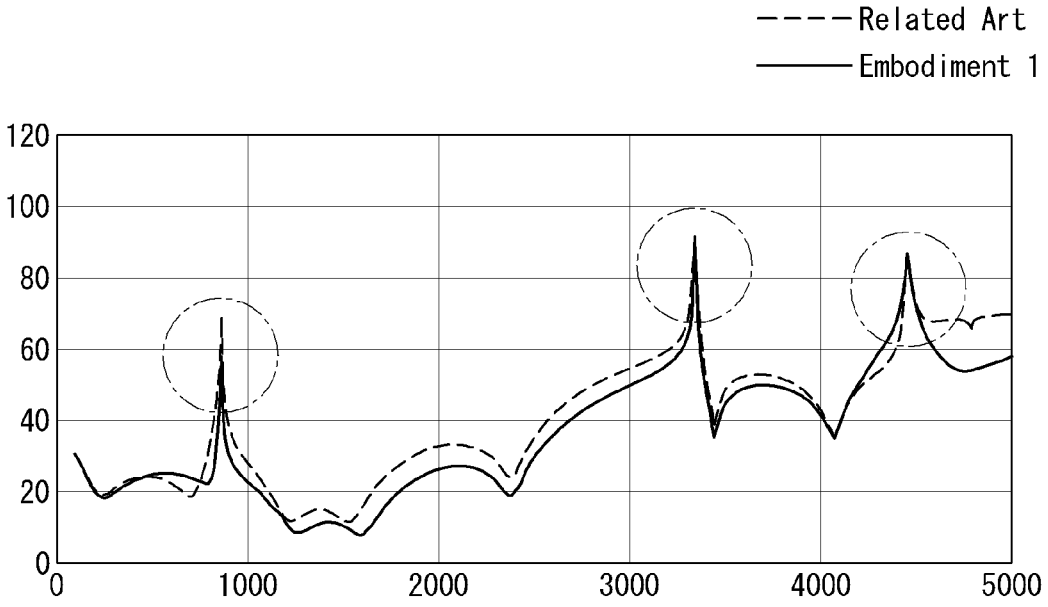
FIG. 7 is a graph comparing a transmission loss (TL) of a linear compressor including an intake muffler according to a related art with a transmission loss of a linear compressor including an intake muffler according to a first embodiment of the present disclosure.

FIG. 7 is a graph comparing a transmission loss (TL) of a linear compressor including an intake muffler according to a related art with a transmission loss of a linear compressor including an intake muffler according to a first embodiment of the present disclosure.

It can be seen from FIG. 7 that there is no significant difference in a noise at a peak between the linear compressor including the intake muffler according to the first embodiment of the present disclosure and the linear compressor according to the related art.

According to the inventor's experiments, in the linear compressor including the third muffler according to the first embodiment of the present disclosure, a forward drag coefficient was measured as 104.422, a reverse drag coefficient was measured as 86.06, and an average drag coefficient was measured as 95.241, Accordingly, since the average drag coefficient in the present disclosure can be reduced by about 48% compared to the related art linear compressor, a wind loss occurring during the operation of the compressor can be reduced efficiently.

A second embodiment of the present disclosure is described below with reference to FIGS. 8 and 9.

Figure 8:
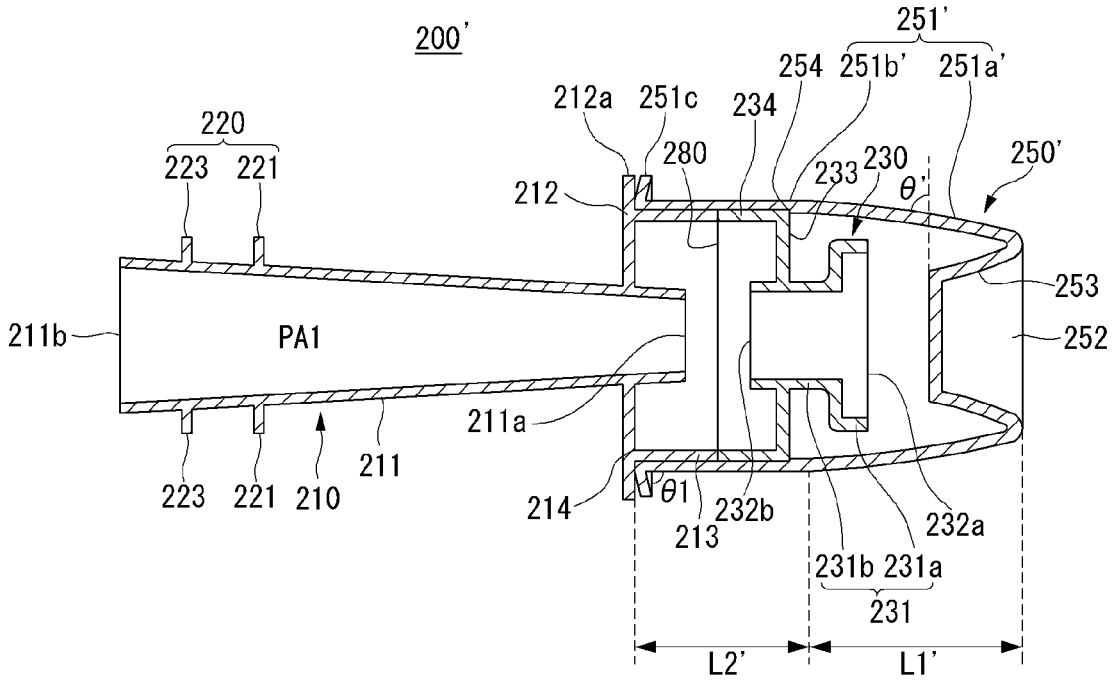
FIG. 8 is a cross-sectional view of an intake muffler according to a second embodiment of the present disclosure.

FIG. 8 is a cross-sectional view of an intake muffler according to a second embodiment of the present disclosure. FIG. 9 is a graph comparing a transmission loss (TL) of a linear compressor including an intake muffler according to a related art with a transmission loss of a linear compressor including an intake muffler according to a second embodiment of the present disclosure.

In the following embodiments, the same reference numerals are given to the same components as the first embodiment described above, and a detailed description thereof is omitted.

With reference to FIG. 8, an intake muffler 200' according to the second embodiment of the present disclosure is configured such that an axial length L1' of a streamlined portion 251*a'* included in a third muffler body 251' of a third muffler 250' is greater than that in the first embodiment, an axial length L2' of a muffler accommodating portion 251*b'* is less than that in the first embodiment, and the axial length L1' of the streamlined portion 251*a'* is greater than the axial length L2' of the muffler accommodating portion 251*b'*.

In addition, an inclination angle θ' of the streamlined portion 251*a'* is greater than that in the first embodiment.

In the second embodiment, the axial length L1' of the streamlined portion 251*a'* is formed as 22.8 mm, and the streamlined portion 251*a'* has the inclination angle θ' of about 83.5° with respect to a radial direction perpendicular to the axial direction.

Figure 9:
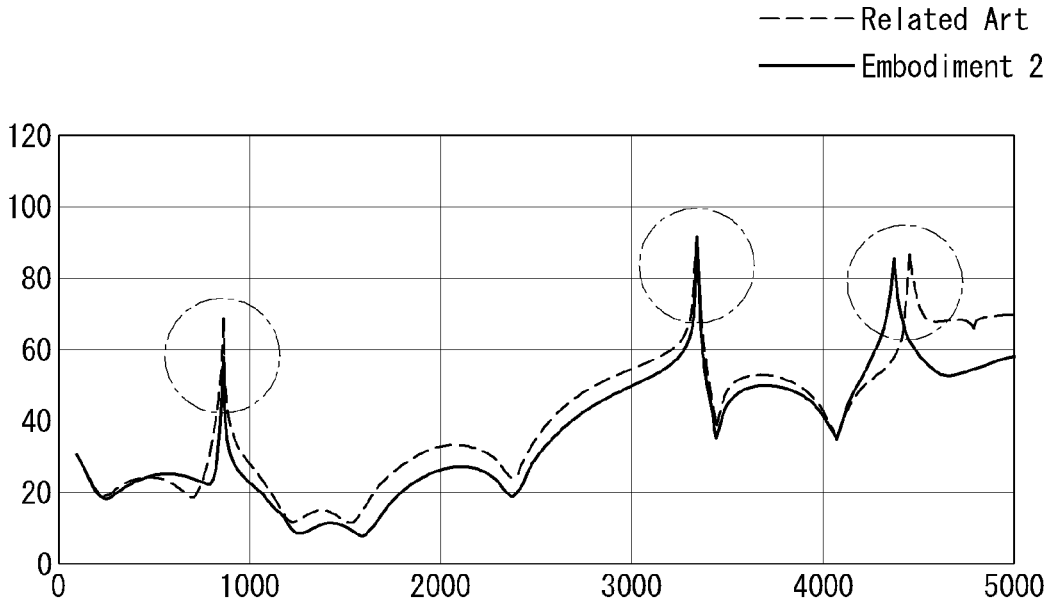
FIG. 9 is a graph comparing a transmission loss (TL) of a linear compressor including an intake muffler according to a related art with a transmission loss of a linear compressor including an intake muffler according to a second embodiment of the present disclosure.

It can be seen from FIG. 9 that there is no significant difference in a noise at a peak between a linear compressor including an intake muffler according to a second embodiment of the present disclosure and the linear compressor according to the related art.

Accordingly, in embodiments of the present disclosure, an axial length of a streamlined portion of a third muffler body may be greater than or equal to 10 mm, and an inclination angle of the streamlined portion may be less than or equal to 85°.

What is claimed is:

1. A linear compressor comprising:

a shell including an intake pipe that is configured to suction a refrigerant;

a cylinder provided inside the shell;

a piston that is configured to reciprocate in an axial direction inside the cylinder and that includes a piston body; and an intake muffler that is coupled to the piston and that is configured to flow the refrigerant suctioned through the intake pipe into the piston body and reduce a flow noise of the suctioned refrigerant, wherein the intake muffler includes:

a first muffler disposed inside the piston body, a second muffler that is disposed at a rear side of the first muffler in the axial direction and that is in fluid communication with the first muffler, and a third muffler that includes a third muffler body having a cylindrical shape with an empty interior and that is configured to accommodate a portion of a rear end of the first muffler and the second muffler in the third muffler body, wherein the third muffler body includes a streamlined portion having diameters that are reduced toward a rear side of the third muffler body in the axial direction, wherein the third muffler body further includes a muffler accommodating portion that extends in an axial direction in front of the streamlined portion and that is configured to accommodate the portion of the rear end of the first muffler and the second muffler, wherein an axial length of the streamlined portion is less than an axial length of the muffler accommodating portion, wherein the streamlined portion of the third muffler body has an inclination angle that is less than or equal to 85 degrees with respect to a radial direction perpendicular to the axial direction, wherein the third muffler further includes a protrusion that extends forward in the axial direction from a rear end of the streamlined portion, and wherein the protrusion is inclined in an opposite direction to the inclination angle of the streamlined portion.

2. The linear compressor of claim 1, wherein the axial length of the streamlined portion is greater than or equal to 10 mm.

3. The linear compressor of claim 1, wherein the third muffler further includes a through hole that is defined at the protrusion and that is configured to flow the refrigerant suctioned through the intake pipe into the second muffler.

4. The linear compressor of claim 3, wherein a portion of a first muffler body of the first muffler and a second muffler body of the second muffler are press-fitted and coupled to an inner peripheral surface of the third muffler.

5. The linear compressor of claim 4, further comprising a muffler filter disposed between the first muffler and the second muffler.

6. The linear compressor of claim 4, further comprising an intake guide portion configured to guide the refrigerant discharged from a discharge hole of the first muffler to an intake port of the piston.

7. The linear compressor of claim 6, wherein the intake guide portion is defined at an outer peripheral surface of the first muffler.

8. The linear compressor of claim 6, wherein the intake guide portion surrounds a portion of the first muffler body.

9. The linear compressor of claim 6, wherein the intake guide portion includes a first extension extending outward in a radial direction from an outer peripheral surface of the first muffler and a second extension spaced apart from the first extension.

10. The linear compressor of claim 5, wherein the first muffler body defines an inlet hole at a rear end into which the refrigerant passing through the muffler filter is received.

11. The linear compressor of claim 4, wherein the first muffler includes a first muffler flange radially provided on an outer peripheral surface of the first muffler body and a first flange extension extending axially rearward from the first muffler flange.

12. The linear compressor of claim 11, wherein the first muffler flange is coupled to a piston flange of the piston.

13. The linear compressor of claim 11, wherein the first muffler flange has a cylindrical shape.

* * * * *